United States Patent [19]

Swenson

[11] Patent Number: 5,065,733

[45] Date of Patent: Nov. 19, 1991

[54] DRESSING TOOL FOR FORM DRESSING OF A GRINDING WHEEL

[76] Inventor: Henry F. Swenson, 22 Homehill La., Roseland, N.J. 07068

[21] Appl. No.: 638,540

[22] Filed: Jan. 8, 1991

[51] Int. Cl.[5] ..... B24B 53/12

[52] U.S. Cl. ..... 125/39; 125/11.21; 125/38; 407/113

[58] Field of Search ..... 125/39, 38, 11.02, 11.21; 407/113

[56] References Cited

U.S. PATENT DOCUMENTS

| | | | |
|---|---|---|---|
| 1,346,056 | 7/1920 | Poulain | 125/39 |
| 2,378,094 | 6/1945 | Nunes-Vaz | 125/39 |
| 4,016,634 | 4/1977 | Barnes | 407/113 |
| 4,230,427 | 10/1980 | Beltari | 407/113 |
| 4,419,979 | 12/1983 | Hughes | 125/39 |
| 4,450,826 | 5/1984 | Remy | 125/11.02 |
| 4,992,007 | 2/1991 | Satran | 407/117 |

FOREIGN PATENT DOCUMENTS

| | | | |
|---|---|---|---|
| 1953544 | 6/1971 | Fed. Rep. of Germany | 125/39 |
| 0607142 | 6/1926 | France | 125/39 |

*Primary Examiner*—Robert A. Rose

*Attorney, Agent, or Firm*—Patrick J. Pinto

[57] ABSTRACT

A dressing tool for form dressing of a grinding wheel comprising a cylindrical body 22 having an open groove 32 formed at one end; said open groove 32 adapted for insertion, seating, and clamping of a chisel-edge diamond 36; said chisel-edge diamond being clamped in said open groove in a substantially centered alignment with an axis of said cylindrical body 22, and said chisel-edge diamond simultaneously clamped in said open groove at a negative angle B by a clamping means 42; said centering alignment and negative angle adjustment provided by an associated matching and removable centering gage.

7 Claims, 1 Drawing Sheet

DRESSING TOOL FOR FORM DRESSING OF A GRINDING WHEEL

BACKGROUND OF THE INVENTION

1. Field of the Invention

This invention is believed to be found in the field of Abraiding and more particularly Accessories for form dressing of grinding wheels.

2. Description of the Prior Art

Tools for form dressing of grinding wheels are known. Typically these tools take the form of point-type dressing tools as exemplified in U.S. Pat. No. 2,562,587 as issued to Swearingen on 07/31/51. Also know are Chisel-Edge dressing tools as exemplified by FIG. 1 and labeled PRIOR ART. In each of the above cited prior art examples the diamond dressing portion 10 of the tool 12 is held in place by a brazing filler 14, generally using a technique similar to that described in U.S. Pat. No. 2,562,587. One of the problems with this type of holder is that as the diamond surface wears the tool must be either re-sharpened, replace the diamond tip, or scrapped. Another problem encountered with the known construction is that of alignment of the diamond dressing tip with the axis of the tool body. This is of particular importance with the chisel type diamond tip. It may be seen by referring to FIG. 2 of the Drawing Labelled PRIOR ART to see the effect of misalignment of the vertical axis of the diamond tip relative to the grinding wheel. As shown in FIG. 2, the top portion of the dressing tip is misaligned with respect to the axis of the tool body. This misalignment is identified as M. Of course any misalignment M will effect the accuracy of the form being shaped on the grinding wheel surface, especially when attempting to blend a radius tangent to a line segment while using the indexing graduations of a dressing apparatus.

It has been determined that a need exists for a dressing tool which can easily have a new dressing tip inserted there-in on a work bench or in place while the body portion is mounted in a dressing apparatus. This replaceable tip should have at least two cutting surfaces and be easily centralized relative to the tool body. The leading edge of the dressing tip should be at or near the axis of the tool body and present a negative angle to the grinding wheel to be dressed.

In the previously cited references and as far as it is known, a Dressing Tool Holder for the easy insertion, centering and clamping of a diamond dressing tip is not known, suggested or disclosed.

It is believed that the present invention will provide an economical as well as a time saving tool for use in the form dressing of a grinding wheel.

SUMMARY OF THE INVENTION

This invention may be summarized, at least in part, with respect to its objects. It is an object of this invention to provide and it does provide a novel wheel dressing tool which holds a removable and replaceable chisel edge diamond tip.

It is another object of this invention to provide and it does provide a dressing tool which clamps a triangular chisel edge diamond at a negative angle to the grinding wheel being dressed.

It is still another object of this invention to provide a dressing tool which clamps a chisel edged diamond tip in a selected array for allowing the diamond tip to be reversed and used at least twice.

It is still yet another object of this invention to provide a dressing tool and centering gage for accurately positioning the diamond tip with respect to the axis of the tool body.

In addition to the above summary, the following disclosure is detailed to insure adequacy and aid in the understanding of this invention. This disclosure, however, is not intended to cover each new and inventive concept, no matter how it may later be disguised either by variations in form or addition by further improvements. For this reason, there has been chosen specific embodiments of a Dressing Tool for form dressing of grinding wheels. These specific embodiments have been chosen for the purpose of illustration and description, as shown in the accompanying drawing wherein:

BRIEF DESCRIPTION OF THE DRAWING

In the following description and claims, various details are identified by specific names for convenience. These names are intended to be substantially generic in their application. The corresponding reference characters refer to like members throughout the several figures of the drawings.

The drawings, accompanying and forming a part of this specification, disclose certain details associated with a dressing tool for form dressing of a grinding wheel and an associated centering gage. These details are for the purpose of explanation, but it is to be understood that some details may be modified without departure from the concept and principles of the present invention. It is anticipated that this invention may be incorporated in forms other than shown or described.

Figure 4:
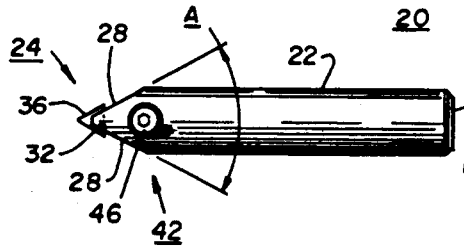
FIG. 4 represents a plan view of the dressing tool of the present invention, this view being in the same scale as FIG. 1.
Figure 3:
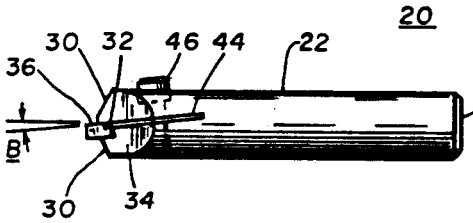
FIG. 3 represents a side elevation view of the dressing tool of the present invention, this view partly diagrammatic and showing the mounting of a diamond tip in a tool body.

EMBODIMENT OF FIG. 3 and 4

The dressing tool of the present invention is generally identified as 20. This dressing tool 20 includes an elongated cylindrical tool body 22 having a first end 24 and a second end 26. The first end 24 is selectively contoured to have a pair of flats 28 and a pair of relief faces 30 formed there-on. The flats 28 have an included angle A which is formed, in a substantially symmetrical array about the central axis of the cylindrical tool body 22. The cylindrical tool body 22 preferably is made of a hardened steel but other suitable materials may be used.

An open groove 32 is formed at the first end 24. This open groove 32 is arrayed to connect each of the flats 28 at substantially ninety degees to a major surface 34 of each of the flats 28. The open groove 32 is selectively sized to receive and hold a chisel-edge diamond tip 36. The groove 32 has a predetermined depth allowing the diamond tip 36 to extend a determined distance beyond the first end 24. The depth of the groove 32 is dependent on the type of diamond tip 36 used. Preferably, the diamond tip 36 is of a triangular design such as a No. 4414 FORMSET® Man-made Diamond. This preferred diamond tip 36 has three equal sides and three substantially equal included angles of sixty degrees. The advantage of using this preferred diamond tip 36 will become apparent below.

Figure 2:
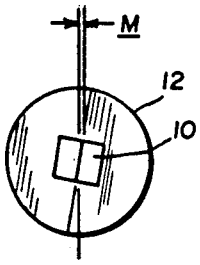
FIG. 2 is a front elevation of the PRIOR ART dressing tool of FIG. 1, this view showing a misalignment of the axis of the diamond with the axis of the tool.
Figure 1:
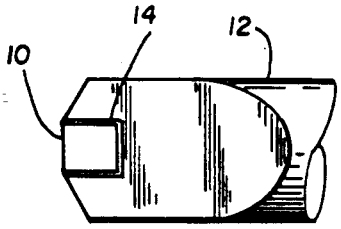
FIG. 1 PRIOR ART
FIG. 1 represents a side elevation of a PRIOR ART dressing tool, this view particularly showing the mounting of a chisel-edge diamond.
Figure 9:
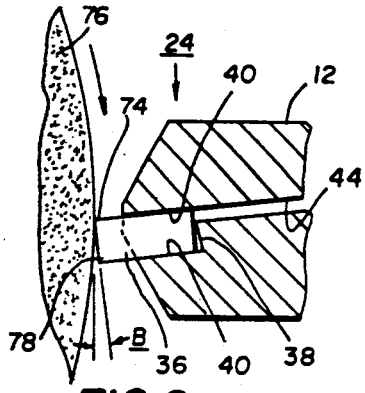
FIG. 9 represents a fragmentary view, in an enlarged scale, of the dressing tool of the present invention, this view particularly showing the construction of an open groove for the insertion of the diamond tip.

Referring in particular to FIG. 3, the open groove 32 is formed at a selected angle B with the central axis of the tool body 22. This angle B may be within the range between six degrees and nine degrees. It has been found that an angle B of eight degrees provides satisfactory results. The bottom surface of the open groove 32 is formed at an angle to the sides 40 of the open groove 32. This angled bottom surface 38, seen in FIG. 9, provides a substantially point contact with an adjacent side of the diamond tip 36, to allow full seating of the diamond tip 36 in the open groove 32 without the interference of particles or bottom radii. The angle of the bottom surface 38 with the sides 40 is approximately five degrees out of square.

Referring again to FIG. 3, a clamping means, generally identified as 42, is employed to retain and clamp the diamond tip 36 in the open groove 32. Preferably the clamping means 42 includes a saw cut 44 of a selected length and a machine screw 46 which is threaded into the cylindrical tool body 22. The clamping means clamps the diamond tip 36 in the open groove 32 by turning the machine screw 46 in a tightening direction.

EMBODIMENTS OF FIGS. 5; 6; AND 7

Figure 6:
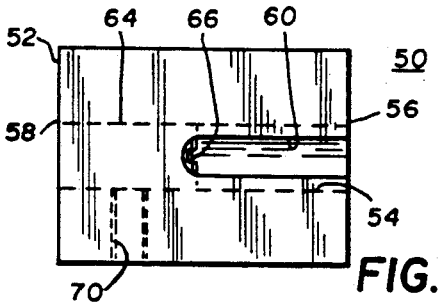
FIG. 6 represents a plan view of the gage block of FIG. 5. This view particularly showing a slotted aperature and a centering groove.
Figure 5:
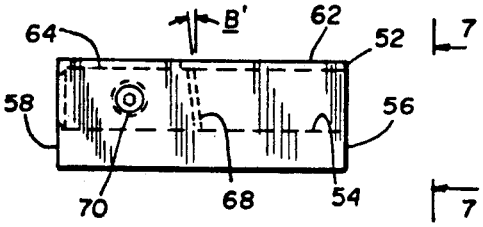
FIG. 5 represents a side elevation view of a gage block for use in centering the diamond tip in the tool body.
Figure 7:
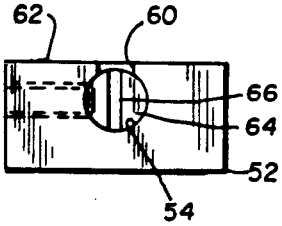
FIG. 7 represents an end elevation of the gaging block of the present invention. This view taken along line 7—7 of FIG. 5.

A gaging block, generally identified as 50, is provided for centering the diamond tip 36 on the center axis of the tool body 22. Referring particularly to FIG. 6, the gaging block 50 includes a block member 52 having an aperture 54 formed there-in. Preferably this aperture 54 extends from one end 56 of the block 52 to its opposite end 58. The aperture aperture 54 is selectively sized and shaped to match and closely mate with the diameter of the tool body 22 to provide a sliding fit. An elongated slotted aperture 60 extends from the aperture 54 to one side 62 of the block 52. A centering pin 64 such as a hardened dowel is also provided. This centering pin 64 has one of its faces precision machined with a centering groove 66 in alignment with its center line. This centering groove 66 is adapted to center the diamond tip 36 with respect to the central axis of the tool body 22. It has been found that a centering groove 66 of 1 mm. (0.040 In) wide × 1 mm. deep provides excellent results with a diamond tip 36 having three equal sides. The dimensions of the centering groove may have to be adjusted for diamond tips 36 having other than three equal sides. It is to be noted that a V-shaped centering groove may be substituted for the U-shaped centering groove shown. The centering groove 66 and its associated face 68 is machine at an angle B′ with respect to the axis of the centering pin 64, as may be seen in FIG. 5. The angle B′ of the centering pin preferably matches angle B of the dressing tool 20. Referring now to FIG. 6 and 7, The centering pin 64 is located in the block 52 with its centering groove 66 vertical as seen in FIG. 7 and with the centering groove 66 exposed as seen in FIG. 6. The properly located centering pin 64 is locked in the block 52, by a locking means 70 such as a setscrew or pin.

USE AND OPERATION

Figure 8:
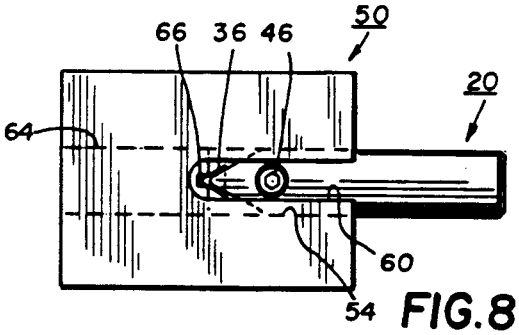
FIG. 8 represents a plan view of the dressing tool inserted into the gaging block for centering the diamond tip.

When it is desired to install a sharp chisel edge diamond tip 36 into a dressing tool body 22, and it is necessary that that diamond be centered in the tool. A mechanic may center the diamond tip 36 in the tool body by using an optical comparitor. An easier method would be to insert the tool body 22 with the diamond tip 36 inserted therein into the gaging block 50, with the head of the clamping screw 46 in the elongated slot 60. Prior to fully inserting the dressing tool 20 into the gaging block 50 the screw 46 is loosened sufficiently to allow the tip 36 to slide in the groove 32. Access to the head of the screw 46 is provided by the elongated slot 60 which has been sized to slidingly accept the head of the screw 46. As an example, a 6.3 mm. (0.250 in.) wide slot is sufficient for a 6-32 socket head screw. After the diamond tip 36 is unclamped, the dressing tool 20 is carefully and fully inserted into the gaging block 50 where-upon the two exposed sides of the diamond tip 36 simultaneously contact the exterior corners of the U-shaped centering groove 66, as may be seen in FIG. 8. Subsequently, the clamping means 42 is tightened sufficiently to retain the diamond tip 36 in a substantially centered position with respect to the central axis of the tool body 22.

Referring to FIG. 9, the now centered diamond tip 36 is correctly positioned in the tool body 22. This correct positioning also provides that the dressing tip 36 have its dressing or leading edge 74 at or near the axis of the tool body 22. This correct positioning also provides a negative angle B. This negative angle B positions the diamond tip 36 so that only the top leading edge 74 of the diamond tip 36 is in contact with the wheel 76 to be dressed.

It is to be noted that another benefit of the present invention is that after the top leading edge 74 wears, the diamond tip 36 need only be removed and rotated 180 degrees such that the former trailing edge 78 is now positioned as the top leading edge. When a diamond tip 36 has three equal sides it is possible to have six sharp points available to be used as a top leading edge.

Yet another feature of the present design is that the tip is substantially self-sharpening, meaning that after the top leading edge 74 is worn beyond practical use and the tip reversed, the worn portion will provide a negative angle greater than B.

It is to be noted that when a diamond tip 36 having three equal sides is used the angle A, as seen in FIG. 4, is preferably 55 degrees. This angle A should be less than the included angle of the diamond tip to be used.

Terms such as "left", "right", "up", down", "bottom", "top", "front", "back", "in", "out", and the like are applicable to the embodiments shown and described in conjunction with the drawings. These terms are merely for the purpose of description and do not necessarily apply to the position in which the dressing tool of the present invention may be utilized.

While these particular embodiments of an improved apparatus and method have been shown and described, it is to be understood that the invention is not limited thereto and protection is sought to the broadest extent the prior art allows.

What is claimed is:

1. A dressing tool for form dressing of a grinding wheel, said dressing tool adapted for clamping a chisel-edge diamond, said dressing tool comprising:

(a) an elongated cylindrical body having a first end, a second end, and a central axis, said second end adapted for holding said dressing tool in a tool holder of a wheel dressing apparatus;

(b) said first end having a selected contour including:

(b1) a pair of diametrically opposed flats, said flats having a predetermined included angle therebetween, said predetermined included angle symmetrically arrayed about said central axis;

(b2) an open groove transversely connecting each of said flats, said open groove being simultaneously disposed substantially at 90 degrees to said flats and at a selected angle with respect to said central axis, said groove having a selected configuration and depth for insertion, seating, and holding of a chisel-edge diamond at a selected disposition with respect to said central axis, said chisel-edge diamond having at least three sides, said selected configuration of said open groove including two substantially parallel side walls and a bottom wall, said bottom wall being disposed at an acute angle with respect to at least one of said side walls, said acute angle adapted for providing a substantially point contact with one abutting side of said chisel-edge diamond while said side walls are adapted for said holding;

(c) a clamping means adapted for clamping and holding said chisel-edge diamond in said open groove at said selected disposition said clamping means including a sawcut formed at the bottom of said open groove, said sawcut being of a selected length and extending from one corner of said groove while having a substantially parallel alignment with said sidewall, and a threaded fastener selectively positioned along the length of said sawcut, said threaded fastener adapted for providing said clamping as and when said fastener is tightened; and (d) said selected disposition providing for the positioning of a leading dressing edge of said chisel-edge diamond in substantially centered alignment with said central axis while providing a negative angle for a trailing edge of said chisel-edge diamond, said leading dressing edge and trailing edge being distal said abutting side.

2. A dressing tool as recited in claim 1 wherein said serected angle of said open groove is between 6 and 9 degrees.

3. A dressing tool as recited in claim 1 wherein said chisel-edge diamond is man-made and is an equilateral triangle, said equilateral triangle providing for at least six sharpened leading edges.

4. A dressing tool as recited in claim 1 wherein said centering groove is formed in one face of a dowel pin, said dowel pin being hardened for minimizing wear of said groove due to contact with said chisel-edge diamond, said dowel pin being sized to closely fit into said first aperture at a selected position, and said dowel pin being secured in said first aperture by and with a locking means.

5. A dressing tool as recited in claim 1 wherein said elongated cylindrical body is a hardened metal.

6. A dressing tool as recited in claim 3 wherein said included angle of said diametrically opposed flats is Fifty-five degrees of arc, said included angle being adapted to provide full exposure of said leading dressing edge and adjacent sides of said chisel-edge diamond.

7. In combination, a dressing tool and detachable centering gage for use in the form dressing of a cylindrical grinding wheel, said combination comprising:

(a) a dressing tool adapted for clamping and holding a chisel-edge diamond said dressing tool including:

(a1) an elongated cylindrical body having a first end, a second end, and a central axis, said second end adapted for holding said dressing tool in a dressing tool holder of a wheel dressing apparatus;

(a2) said first end having a pair of diametrically opposed flats there-on, said flats being disposed with a predetermined included angle therebetween, said predetermined included angle being symmetrically arrayed about said central axis, an open groove transversely connecting each of said flats, said open groove being substantially at ninety degrees with respect to said flats while simultaneously at a selected angle with respect to said central axis, said groove having a selected configuration and depth for insertion, seating, and holding of a chisel edged diamond at said selected disposition with respect to said central axis, said chisel-edge diamond having at least three sides, said selected configuration of said open groove including two substantially parallel side walls and a bottom wall, said bottom wall being disposed at an acute angle with respect to at least one of said side walls, said acute angle adapted for providing a substantially point contact with one abutting side of said chisel-edge diamond while said side walls are adapted for said holding;

(a3) a clamping means adapted for clamping and holding said chisel-edge diamond in said open groove at said selected disposition, said clamping means including a sawcut formed at the bottom of said open groove, said sawcut being of a selected length and extending from one corner of said groove while having a substantially parallel alignment with said sidewall, and a threaded fastener selectively positioned along the length of said sawcut, said fastener adapted for providing said clamping as and when said fastener is tightened;

(b) a detachable centering gage being adapted to removably fit onto said first end of said dressing tool as and when desired, said centering gage including:

(b1) a block portion having a first aperture formed therin, said first aperture having a selected depth from one end of said block portion, said first aperture being sized for a close sliding fit onto said first end of said cylindrical body;

(b2) an elongated slotted aperture extending for a selected length from said one end of said block portion, said elongated slotted aperture being of sufficient depth for connecting one side of said block portion with said first aperture, said elongated aperture being disposed in a substantially centered alignment with said first aperture; and (b3) a centering groove being of a selected depth and width, said centering groove being formed at the bottom of said first aperture, said centering groove being disposed for providing a centered alignment of a leading edge of said chisel-edge diamond while simultaneously providing a negative angle for a trailing edge of said chisel edge diamond as and when said dressing tool is seated therein, said elongated aperture allowing for the tightening of said threaded fastener after said centering of said chisel-edge diamond with said central axis.

* * * * *